US007029366B2

(12) United States Patent
Montandon

(10) Patent No.: US 7,029,366 B2
(45) **Date of Patent: *Apr. 18, 2006**

(54) METHOD AND APPARATUS FOR ABRASIVE CIRCULAR MACHINING

(75) Inventor: Jean-Claude Montandon, Arch (CH)

(73) Assignee: HTT Hauser Tripet Tschudin AG, Biel-Bienne (CH)

( * ) Notice: Subject to any disclaimer, the term of this patent is extended or adjusted under 35 U.S.C. 154(b) by 12 days.

This patent is subject to a terminal disclaimer.

(21) Appl. No.: 10/919,440

(22) Filed: Aug. 17, 2004

(65) Prior Publication Data

US 2006/0040585 A1 Feb. 23, 2006

(51) Int. Cl.
*B49D 24/00* (2006.01)

(52) U.S. Cl. ..... 451/5; 451/49; 451/57; 451/177; 451/189; 451/190; 451/194; 451/223; 451/261; 451/262

(58) Field of Classification Search ..... 481/5, 481/49, 57, 177, 189, 190, 194, 223, 261, 481/262

See application file for complete search history.

(56) References Cited

U.S. PATENT DOCUMENTS 4,439,951 A * 4/1984 Oppelt et al. ..... 451/194
5,228,241 A * 7/1993 Ohta et al. ..... 451/5
6,283,837 B1 * 9/2001 Vorbuchner ..... 451/58

FOREIGN PATENT DOCUMENTS

| | | | |
|---|---|---|---|
| DE | 101 26 796 | A1 | 12/2002 |
| JP | 10-128647 | A | 5/1998 |
| WO | WO-99/32258 | A1 | 7/1999 |
| WO | WO-99/42248 | A1 | 8/1999 |
| WO | WO-01/60565 | A1 | 8/2001 |

* cited by examiner

*Primary Examiner*—George Nguyen
*Assistant Examiner*—Shantese McDonald
(74) *Attorney, Agent, or Firm*—Birch, Stewart, Kolasch & Birch, LLP

(57) ABSTRACT

For the machining of a workpiece (18) rotating about a workpiece axis, a first abrasive tool (20), which rotates about a first tool axis, and the workpiece (18) are advanced towards one another, in order to machine a first workpiece face in a first abrasive operation. Further, a second abrasive tool (54), which rotates about a second tool axis (56), is advanced towards the workpiece (18), in order to machine a second workpiece face in a second abrasive operation. The two workpiece faces are designed rotationally symmetrically with respect to the workpiece axis and are arranged adjacently to one another in such a way that a sharp, burr-free, circular transition edge is formed between them. The two abrasive operations are controlled in such a way that they are terminated at the same time. The method and apparatus for abrasive circular machining allow a reliable and accurate machining of workpieces with a sharp and a burr-free transition edge between two rotationally symmetrical faces, even in the manufacture of large series.

10 Claims, 3 Drawing Sheets

10

METHOD AND APPARATUS FOR ABRASIVE CIRCULAR MACHINING

TECHNICAL FIELD

The invention relates to a method for the abrasive circular machining of a workpiece and to an apparatus for carrying out the abrasive circular machining method according to the precharacterizing clauses of the independent patent claims.

PRIOR ART

For many applications, workpieces are required which are of at least partially rotationally symmetrical design and have a workpiece axis defining the axis of symmetry, and also two adjacent faces which are designed rotationally symmetrically with respect to the workpiece axis and between which is formed a circular transition edge. Such workpieces are used, for example, as a valve or nozzle needles, typically one of the two faces forming a sealing seat and the other of the two faces forming a guide face for the valve or nozzle needle. So that such valve or nozzle needles can also be used for high-pressure applications, such as, for example, fuel injection systems for modern petrol or diesel engines, where sometimes pressures of above 1000 bar are to be controlled, stringent requirements must be fulfilled in terms of adherence to manufacturing tolerances. In particular, the transition edge between the seat face and the guide face must be formed so as to be as sharp-edged and as burr-free as possible.

For the machining of workpieces of the abovementioned type, chip-forming methods with geometrically indeterminate cutting edges (also designated as abrasive machining methods), in particular grinding and honing, are employed. A method for abrasive circular machining may therefore be, for example, a circular grinding method or a circular honing method. Accordingly, both a circular grinding machine and a circular honing machine are to be considered as an apparatus for carrying out an abrasive circular machining method.

The publication WO 01/60565 (Robert Bosch GmbH) discloses a grinding method and a grinding machine which make it possible to produce a valve needle for a fuel injection valve by means of circular grinding. The grinding machine is provided with a grinding wheel and with a deburring mandrel arranged opposite the grinding wheel with respect to the workpiece. When the grinding wheel grinds a grinding face of the workpiece, a burr occurs, which projects beyond the transition edge formed between this grinding face and an adjacent face, into the region of the adjacent face. The deburring mandrel is arranged and designed in such a way that, as a result of the rotation of the workpiece rotating about its axis, the burr is pressed back onto the grinding face by the deburring mandrel and is ground down by the grinding wheel during the next contact.

It became apparent that the grinding method and the grinding machine according to the publication WO 01/60565 have disadvantages for the mass manufacture of large workpiece series. To be precise, it repeatedly happens that burr formation is not reliably prevented by the deburring mandrel. A complicated rechecking of the workpieces is therefore necessary so that the desired manufacturing quality can be ensured.

PRESENTATION OF THE INVENTION

The object of the invention is to specify a method and an apparatus for abrasive circular machining which allow a reliable and accurate machining of workpieces with a sharp and burr-free transition edge between two rotationally symmetrical faces, even in the manufacture of large series.

The solution for achieving the object is defined by the features of the independent patent claims. According to the invention, to machine a workpiece which has a workpiece axis, an abrasive circular machining method is carried out. While the circular machining method is being carried out, the workpiece rotates about the workpiece axis, whilst at the same time a first abrasive tool (in particular, a grinding tool or a honing tool), which rotates about a first tool axis, and the workpiece are advanced towards one another, in order to machine a first workpiece face in a first abrasive operation (in particular, a grinding or honing operation). The machining method according to the invention is distinguished in that a second abrasive tool (in particular, a grinding tool or a honing tool), which rotates about a second tool axis, is advanced towards the workpiece, in order to machine a second workpiece face in a second abrasive operation. The two workpiece faces are designed rotationally symmetrically with respect to the workpiece axis and are arranged adjacently to one another in such a way that a sharp, burr-free, circular transition edge is formed between them. In this case, the two abrasive operations are controlled in such a way that they are terminated at the same time.

In other words, this means that the two abrasive operations are, at least towards their end, carried out simultaneously and terminated at the same time while the workpiece is rotated about the workpiece axis.

While the two abrasive operations are being carried out simultaneously, a burr, which is possibly formed by the first abrasive tool during abrasive machining of the first workpiece face and which projects beyond the transition edge into the region of the second workpiece face and therefore into the region machined by the second abrasive tool, is ground down by the second abrasive tool during the next contact as a result of the rotation of the workpiece above the workpiece axis and within less than one complete revolution of the workpiece. In the same way, a burr, which is possibly formed by the second abrasive tool during the abrasive machining of the second workpiece face and which projects beyond the transition edge into the region of the first workpiece face and therefore into the region machined by the first abrasive tool, is ground down by the first abrasive tool during the next contact within less than one complete revolution of the workpiece. During the simultaneous abrasive machining of the two workpiece faces, any burr formation at the transition edge is thus effectively prevented from the outset.

Further, during the simultaneous abrasive machining of the two workpiece faces, any burrs at the transition edge which were previously formed during a non-simultaneous abrasive machining of the workpiece faces are also ground down. For the burr-free formation of the transition edge after the conclusion of the method according to the invention, it is therefore unimportant whether, before conclusion, one of the two abrasive operations is carried out alone for a certain time and in this case a burr is formed at the transition edge. Owing to the simultaneous execution of the two abrasive operations shortly before conclusion and to the termination of the two abrasive operations at the same time at the conclusion of the machining method according to the invention, any burrs which were previously formed in the region of the transition edge are also ground away.

Since the two abrasive operations are, at least at the end of the machining method according to the invention, carried out simultaneously and terminated at the same time, no burr of any kind is left behind at the transition edge. The term "at the same time" means, in the present context, that any time difference between the end of the first and of the second abrasive operation is too short for burr formation, even when only one of the two abrasive tools is in (grinding) contact with the workpiece during a period corresponding to this time difference. In the event of the grinding of workpieces manufactured from hard metal by means of grinding wheels which are suitable for the grinding of hard metal and are moved at customary grinding speeds of the order of magnitude of between approximately 20 and 60 m/sec with respect to the workpiece, the term "at the same time" means, in the abovementioned sense, that the time difference between the end of the two grinding operations is smaller than approximately 0.5 seconds, preferably smaller than approximately 0.3 seconds, in particular even smaller than approximately 0.2 seconds.

For carrying out the first abrasive operation by the method according to the invention, it is possible that the workpiece is rotated about a workpiece axis stationary during the first abrasive operation and the first abrasive tool is advanced towards the workpiece. Such abrasive operations are typically executed on circular grinding machines in which an elongate workpiece is received between a workpiece spindle mounted on a spindle headstock stationary during the first abrasive operation and a sleeve arranged on a tailstock stationary during the first grinding operation. As an alternative to this, however, it is also possible that the workpiece rotating about the workpiece axis is advanced towards a first abrasive tool rotating about a first tool axis stationary during the first grinding operation. Such abrasive operations are executed, as a rule, by circular grinding machines which are designed for centreless circular grinding (that is to say, for circular grinding without a sleeve). Moreover, in principle, it is also possible that, while the first abrasive operation is being carried out, both the first abrasive tool and the workpiece axis (or a workpiece spindle defining the workpiece axis) are moved at the same time.

In comparison with the grinding method described in WO 01/60565, the machining method according to the invention has the advantage, further, that the two adjacent workpiece faces between which the transition edge is formed are machined at least partially simultaneously (that is to say, at the same time), with the result that the machining time for producing the workpiece is reduced considerably. This is an appreciable advantage particularly for the manufacture of workpieces in large series.

In the course of the method according to the invention, it is possible that the two abrasive operations are carried out only by time control. That is to say, the two abrasive operations are carried out in each case during time spans fixed from the outset, so that, for each of the two faces, a removable amount corresponding to a respective time span is removed by chip cutting. In this case, for carrying out the method according to the invention, the starting times for the two abrasive operations can be fixed so as to be offset by the amount of the time difference between the time spans required for the two abrasive operations. The two abrasive operations are then started at the starting times offset by the amount of this time difference, so that, after the completion of the two abrasive operations, these are terminated at the same time.

According to a preferred embodiment of the invention, however, at least one of the two abrasive operations is executed by measurement control. In the present context, the measurement-controlled execution of an abrasive operation is understood to mean that the workpiece face machined in an abrasive operation is measured during the execution of the abrasive operation and the abrasive operation is terminated as soon as a desired nominal dimension is reached. For carrying out the method according to the invention in this embodiment of the invention, first, after a first measurement of the workpiece face, a first estimated value of the time span necessary for the completion of the measurement-controlled abrasive operation is determined on the basis of the measurement result. This estimated value is subsequently compared with a time value of the time span necessary for completing the other abrasive operation, the time difference between the estimated value for completing the measurement-controlled abrasive operation and the time value for completing the other abrasive operation being determined. If the other abrasive operation is a time-controlled operation, then the time value can be determined on the basis of the time already spent for this abrasive operation. If, by contrast, the other abrasive operation is likewise a measurement-controlled operation, then the time value can be estimated in a similar way to the estimated value for the first measurement-controlled operation. Subsequently, that abrasive operation for which a shorter time up to the completion of the operation has been determined is delayed according to the time difference. After the determination of the time difference and the subsequent delay of one abrasive operation may be carried out several times during the execution of the method according to the invention, in order to increase the chronological accuracy for terminating the two abrasive operations at the same time.

For carrying out the method according to the invention, one of the two machined workpiece faces is designed conically, whilst the other machined workpiece face may be designed either conically or cylindrically.

The method according to the invention is especially suitable for external circular grinding, that is to say for the circular grinding of a workpiece, of which one workpiece face to be machined is of externally conically design and of which the other workpiece to be machined is either likewise of externally conical or of cylindrical design. For external circular grinding, typically grinding wheels are used, the diameters of which are substantially larger than the diameter of the workpiece in the region to be ground. In this case, the advantage is particularly great, since burr formation during the use of comparatively large grinding wheels is a considerable problem.

In principle, however, the method according to the invention may also be used for combined external and internal circular grinding (that is to say, for the grinding of an internally conical workpiece face and of a further workpiece face which is adjacent to the latter and which is of either externally conical or cylindrical design) or even for the internal circular grinding of two adjacent internally conical workpiece faces. In these instances, in each case grinding wheels with a comparatively small diameter are used for grinding the internally conical workpiece faces.

An abrasive apparatus designed for carrying out the method according to the invention for the abrasive circular machining of a workpiece may be, in particular, a grinding machine or honing machine which comprises a workpiece spindle which rotates about a workpiece-spindle axis and which is provided with a workpiece holder designed for receiving the workpiece. The abrasive apparatus comprises, further, a first abrasive tool rotating about a first tool axis and a first advancing device, in order to advance the first abrasive tool and the workpiece towards one another. The first advancing device is designed in such a way that, by means of the first advancing device, either the first abrasive tool can be advanced towards the workpiece or the workpiece, together with the workpiece spindle, can be advanced towards the first abrasive tool. However, both the first abrasive tool and the workpiece, together with the workpiece spindle, may also be moveable at the same time with respect to a stationary base, in order to advance the first abrasive tool and the workpiece towards one another. The abrasive apparatus according to the invention comprises, further, a second abrasive tool rotating about a second tool axis, a second advancing device, which is designed for advancing the second abrasive tool towards the workpiece, and a control device for controlling the abrasive apparatus. The control device is designed for controlling the first advancing device in such a way that the first abrasive tool and the workpiece are advanced towards one another by means of the first advancing device, in order to machine a first workpiece face in a first abrasive operation. The control device is designed, further, for controlling the second advancing device in such a way that the second abrasive tool is advanced towards the workpiece by means of the second advancing device, in order to machine a second workpiece face in a second abrasive operation, the two workpiece faces being designed rotationally symmetrically with respect to the workpiece-spindle axis and being arranged adjacently to one another in such a way that a circular transition edge is formed between them. Furthermore, the control device for controlling the two advancing devices is designed in such a way that the two abrasive operations are terminated at the same time.

The first advancing device may comprise a first slide, by means of which either the workpiece, together with the workpiece spindle, or the first abrasive tool can be moved along a first straight linear guide obliquely or at right angles to the workpiece-spindle axis, in order to advance the first abrasive tool and the workpiece towards one another. In the event of an advance of the first abrasive tool towards the workpiece at right angles, this is designated as a straight infeed, and, in the case of an advance deviating from a right angle, as an oblique infeed.

As an alternative to a first slide moveable along a first linear guide, the first advancing device may also comprise other suitable advancing means, for example a platform pivotable about a pivot axis.

Moreover, a further translational movement axis may be provided between the first abrasive tool and the workpiece spindle, in order to make it possible to have a plane relative movement with two degrees of translational freedom between the workpiece and the first abrasive tool.

According to preferred variant of the invention, the second advancing device comprises a second slide, by means of which the second abrasive tool can be moved along a second straight linear guide obliquely or at right angles to the workpiece-spindle axis, the second linear guide being arranged in such a way that the second abrasive tool can be advanced towards the workpiece from a side located opposite the first abrasive tool with respect to the workpiece. Like the first advancing device, the second advancing device may also be arranged in the manner of an oblique infeed or in the manner of a straight infeed.

In this case, the second linear guide comprises at least two elongate guide elements which guide the second slide and define the direction of movement of the second slide and which define two geometric axes parallel to one another. The guide elements may be, for example, rails or guide rods. The guide elements are arranged in such a way that the (geometric) workpiece-spindle axis leads through between the axes defined by the guide elements. The arrangement of the guide elements such that the axes defined by these run past the workpiece-spindle axis on both sides ensures a high rigidity of the abrasive apparatus for workpiece machining by means of the second abrasive tool and consequently high machining precision.

Preferably, the guide elements of the second advancing device are even arranged in such a way that the workpiece-spindle axis even leads through between the guide elements themselves, not merely through between the prolongations of these. An especially high rigidity of the abrasive apparatus is thereby achieved.

Instead of a second slide moveable along a second linear guide, the second advancing device may, in turn, comprise other suitable advancing means, for example a platform pivotable about a pivot axis.

The second abrasive tool may be, in particular, a grinding wheel. As regards the abovementioned variant of the invention with a second slide moveable along a second linear guide, the abrasive apparatus then preferably further comprises a trueing tool for trueing the grinding wheel. The trueing tool may be arranged on that side of the grinding wheel which is located opposite the workpiece-spindle axis, in such a way that the grinding wheel can be moved selectively either towards the workpiece or towards the trueing tool by means of the second slide. A compact and space-saving structure of the abrasive apparatus is thereby achieved.

Preferably, the second advancing device comprises a third slide, by means of which the second abrasive tool can be moved, parallel to the workpiece-spindle axis, along a third straight linear guide. In this case, the third linear guide comprises at least three elongate guide elements which guide the third slide and define the direction of movement of the third slide and which in each case define geometric axes parallel to one another. The guide elements may be, for example, rails or guide rods. The guide elements are arranged in such a way that the workpiece-spindle axis lies within a space which is delimited by an imaginary envelope (that is to say, an envelope in the geometric sense) around the at least three infinitely long axes of the third linear guide. In other words, the guide elements of the third linear guide are arranged in such a way that the workpiece-spindle axis passes through a polygon which lies in a plane normal to the workpiece-spindle axis and the corners of which are defined by the axes of the third linear guide which are assigned to the guide elements. This arrangement of the guide elements ensures, in turn, a high rigidity of the abrasive apparatus for workpiece machining by means of the second abrasive tool and therefore high machining accuracy.

If the second advancing device comprises both a second slide moveable along the second linear guide obliquely or at right angles to the workpiece-spindle axis and a third slide moveable, parallel to the workpiece-spindle axis, along the third linear guide, preferably the second slide is arranged moveable on the third slide by means of the second linear guide, so that the second slide follows the third slide in the manner of series kinematics. A comparatively simple and rigid construction of the second advancing device is thereby obtained. In principle, however, the reverse series-kinematic arrangement is also possible for specific applications, that is to say the arrangement of the slides such that the third slide is arranged moveably on the second slide by means of the third linear guide.

The abrasive apparatus may comprise, further, a tailstock which is provided with a sleeve for stabilizing one longitudinal end of the workpiece during the workpiece machining. In this case, preferably, the second advancing device is arranged on the tailstock. An especially simple and rigid construction of the abrasive apparatus is thereby achieved.

In the case of an abrasive apparatus which is provided with a tailstock and a sleeve and the second advancing device of which further comprises a third slide which is moveable parallel to the workpiece-spindle axis along a third linear guide, the third linear guide is advantageously arranged on the tailstock. The third slide is then moveable along the third linear guide with respect to the tailstock. Further, advantageously, in an arrangement leading through a passage formed in the third slide, the sleeve is connected to the tailstock in such a way that the third slide is moveable along the sleeve independently of the sleeve. The sleeve may itself be provided with an adjusting device which is designed for adjusting or moving the sleeve parallel to the workpiece-spindle axis with respect to the tailstock. The third slide and the sleeve are then moveable, parallel to the workpiece-spindle axis, with respect to the tailstock independently of one another.

Further advantageous embodiments and feature combinations of the invention may be gathered from the following detailed description and from the patent claims taken as a whole.

BRIEF DESCRIPTION OF THE DRAWINGS

In the drawings used to explain the exemplary embodiment.

Identical parts are basically given the same reference symbols in the figures.

Ways of Implementing the Invention

Figure 1:
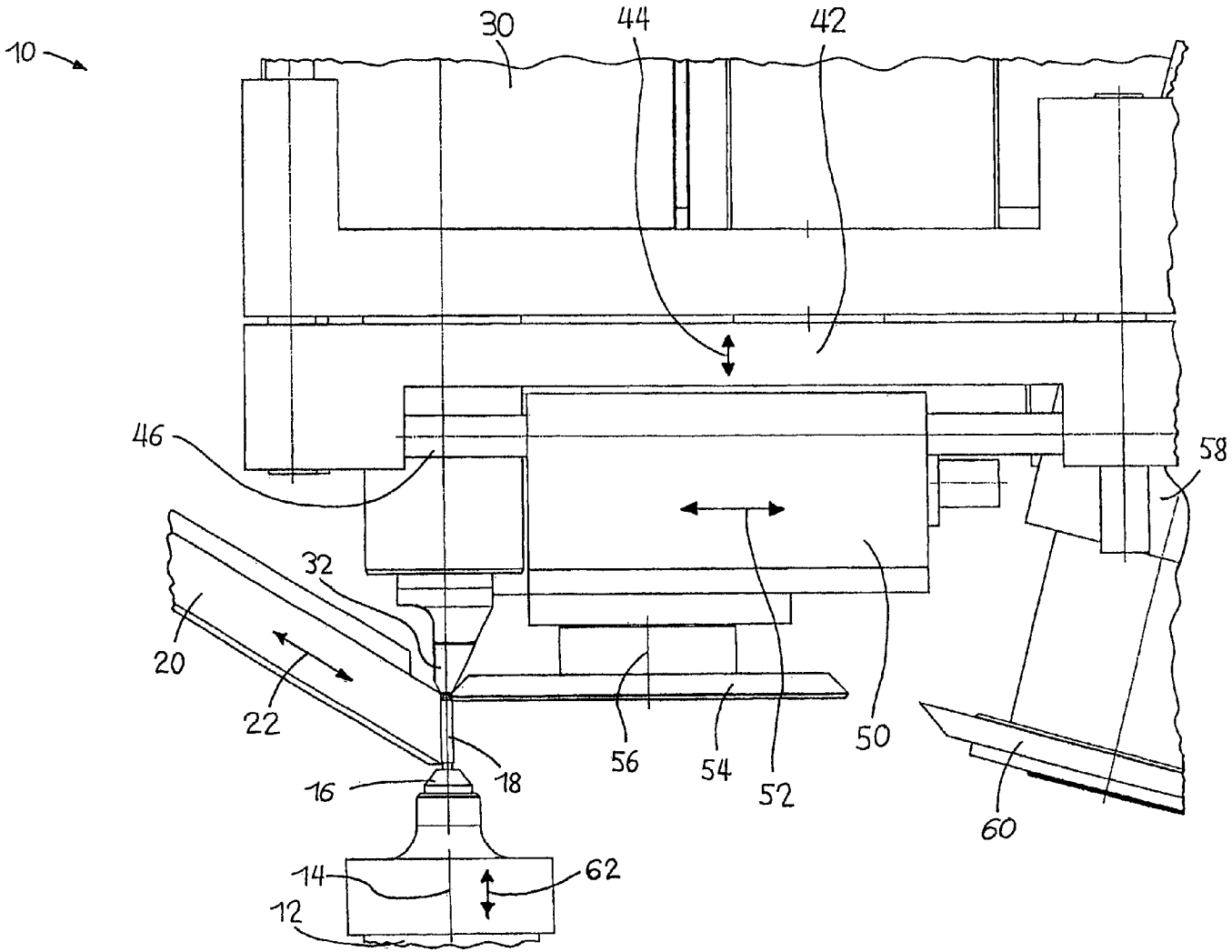
FIG. 1 shows a simplified part-view from above of an abrasive apparatus according to a first preferred embodiment of the invention, in a first working position.
Figure 2:
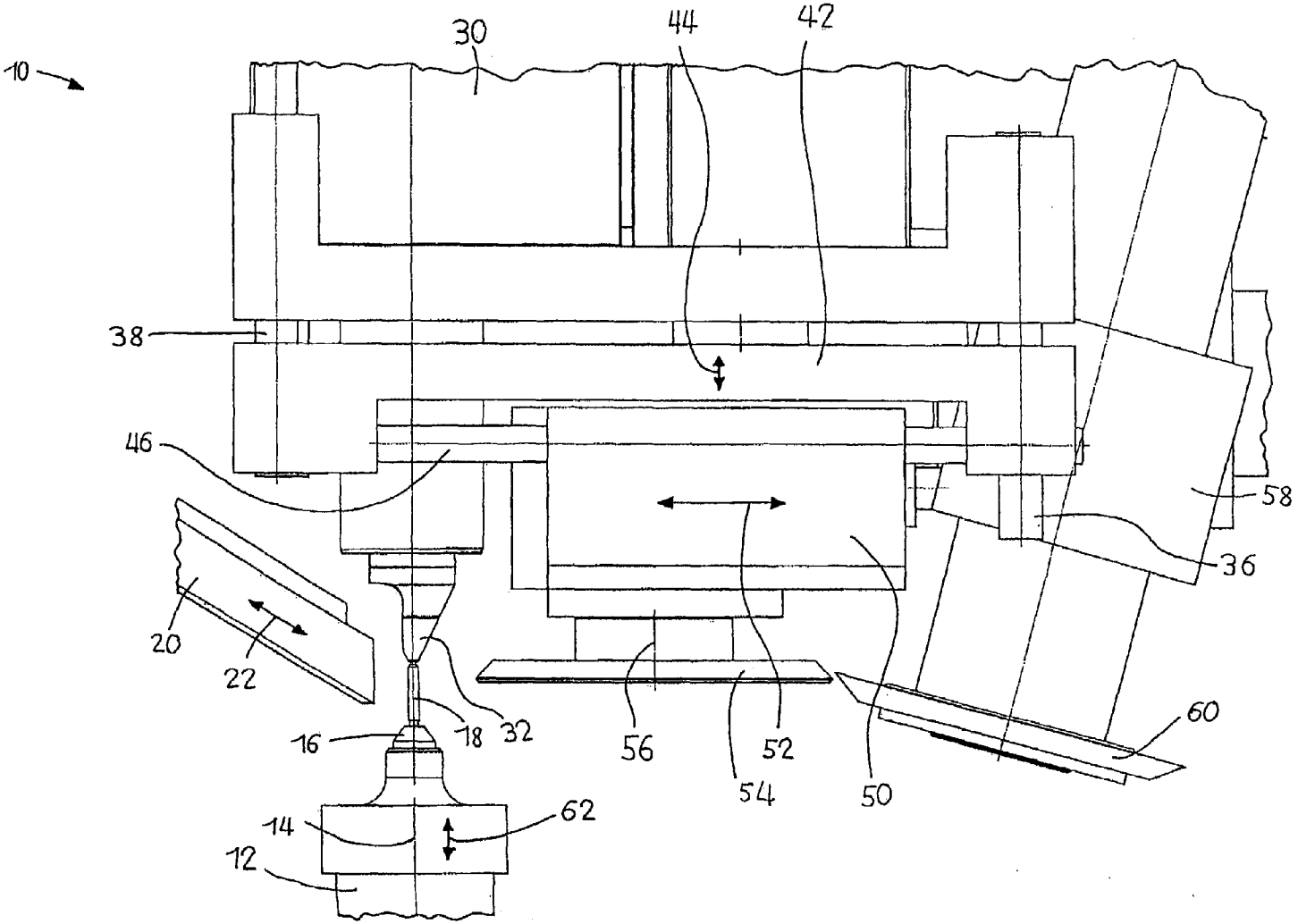
FIG. 2 shows an illustration, corresponding to FIG. 1, of the abrasive apparatus from FIG. 1 in a second working position.
Figure 3:
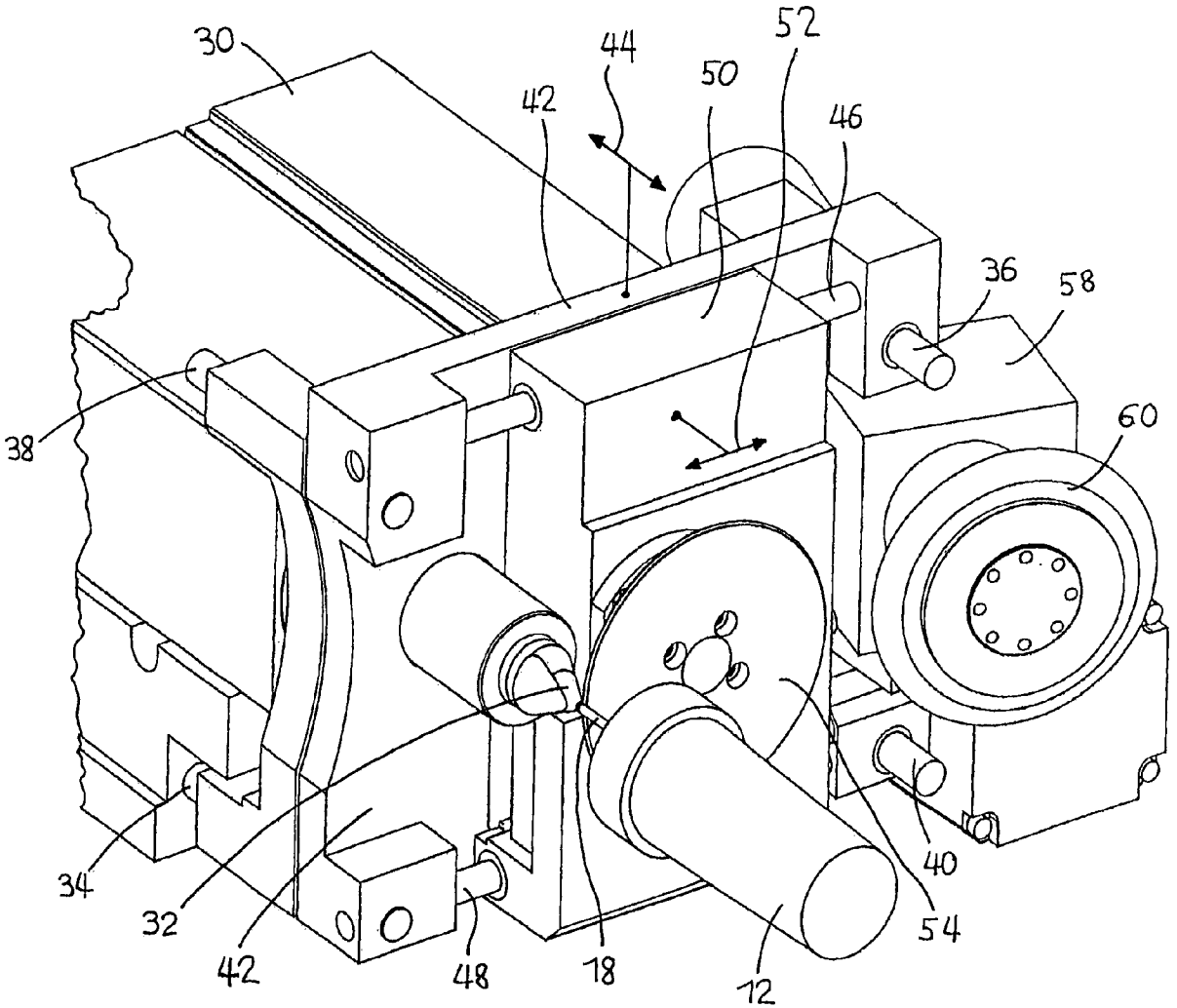
FIG. 3 shows a simplified perspective part-view of the abrasive apparatus from FIG. 1.

FIGS. 1–3 illustrate an external circular grinding machine 10 which has a stable stationary machine bed (not illustrated). Arranged on the machine bed is a straight linear guide (not illustrated) which is designated below as the fourth linear guide. A slide (not illustrated), designated below as the fourth slide, can be moved rectilinearly on the fourth linear guide, as is indicated in the figures by the double arrow 62.

Arranged firmly on the fourth slide is a workpiece-spindle headstock (not illustrated), in which a workpiece spindle 12 is mounted rotatably about an essentially horizontal workpiece-spindle axis 14, the workpiece-spindle axis 14 extending parallel to the direction of the movement of the fourth slide on the fourth linear guide. Arranged at an overhung end of the workpiece spindle is a workpiece clamping device 16, in which one longitudinal end of an elongate workpiece 18 is clamped. The workpiece spindle 12 is driven by a motor (not illustrated) in such a way that, during grinding, the said workpiece spindle rotates at a rotational speed of approximately 800 rev/min about the workpiece-spindle axis 14.

Arranged on the machine bed is a further straight linear guide (not illustrated) which is designated below as the first linear guide. A slide (not illustrated), designated below as the first slide, can be moved along the first linear guide obliquely to the workpiece-spindle axis 14. The first slide carries the main spindle headstock (not illustrated) of the external circular grinding machine 10, a first grinding wheel 20, designated as the main grinding wheel 20, being mounted in the main spindle headstock rotatably about a first essentially horizontal tool axis (not illustrated). The first slide and the first linear guide are part of a first advancing device which serves for advancing the first grinding wheel 20 towards the workpiece 18 and for moving it away from the latter again, as indicated by the double arrow 22 in the figures.

The first grinding wheel 20 designed for grinding a cylindrical face of the workpiece 18, the workpiece 18 having a diameter of approximately 4 mm in the region of this cylindrical face. The first grinding wheel 20 has a wheel diameter of approximately 500 mm and is driven by a motor (not illustrated) in such a way that, during grinding, the said grinding wheel rotates at a rotational speed of approximately 1750 rev/min about the first tool axis.

Further, a tailstock 30 is mounted firmly, opposite the workpiece-spindle headstock, on the fourth slide. A sleeve 32 projecting in the direction of the workpiece-spindle headstock is arranged on that end face of the tailstock 32 which faces the workpiece-spindle headstock, this sleeve being moveable, parallel to the workpiece-spindle axis 14, with respect to the tailstock 30 by means of a hydraulic drive.

The workpiece spindle 12 and the sleeve 32 are arranged in such a way that the workpiece 18 clamped at one longitudinal end in the workpiece clamping device 16 is received between the workpiece spindle 12 and the sleeve 32, the side workpiece being stabilized at the other longitudinal end, during its rotation about the workpiece-spindle axis 14, by the sleeve centre. Moreover, the tailstock 30, the workpiece-spindle headstock and the main spindle headstock moveable on the first linear guide are arranged with respect to one another in such a way that the main grinding wheel 20 can be advanced towards the workpiece 18 between the workpiece spindle 12 and the sleeve centre by means of the first advancing device.

The tailstock 30 has arranged on it four straight guide rods 34, 36, 38, 40 which are arranged in each case parallel to the workpiece-spindle axis 14 and which project in the direction of the workpiece-spindle headstock from that end face of the tailstock 30 which faces the workpiece-spindle headstock. The four guide rods 34, 36, 38, 40 are part of a further straight linear guide which is designated below as the third linear guide. Arranged directly in front of that end face of the tailstock 30 which faces the workpiece-spindle headstock is a further slide 42, designated below as the third slide 42, which is provided with four guide bushes through which lead the four guide rods 34, 36, 38, 40 of the third linear guide. The third slide 42 is moveable, parallel to the workpiece-spindle axis 14, with respect to the tailstock 30 along the third linear guide in a region between the tailstock 30 and the workpiece-spindle headstock, as is indicated by the double arrow 44 in FIGS. 1–3.

The four guide rods 34, 36, 38, 40 of the third linear guide are arranged in such a way that the form the corners of a rectangle which correspond approximately to the cross section of the tailstock 30. Further, the four guide rods 34, 36, 38, 40 are arranged with respect to the workpiece-spindle axis 14 in such a way that the workpiece-spindle axis 14 leads through the rectangle spanned by the four guide rods 34, 36, 38, 40 of the third linear guide.

A sleeve passage running coaxially to the workpiece-spindle axis 14 is formed in the third slide 42. The sleeve 32 projecting from the end face of the tailstock 30 extends through this passage, so that the third slide 42 is moveable along the third linear guide independently of the sleeve 32.

On the front side of the third slide 42, the said front side being remote from the tailstock 30 and facing the workpiece-spindle headstock, are arranged two straight guide rods 46, 48 which in each case extend transversely to the workpiece-spindle axis 14 and essentially horizontally. These two guide rods 46, 48 are part of a further straight linear guide which is designated below as the second linear guide. Directly in front of the front side of the third slide 42, the said front side facing the workpiece-spindle headstock, is arranged a further slide 50, designated below as the second slide 50, which is provided with two guide bushes through which lead the two guide rods 46, 48 of the second linear guide. The second slide 50 is moveable transversely to the workpiece-spindle axis 14 and essentially horizontally with respect to the third slide 42 along a second linear guide in a region between the third slide 42 and the workpiece-spindle headstock, as is indicated by the double arrow 52 in the figures.

The guide rods 46, 48 of the second linear guide are arranged essentially vertically one above the other on the third slide 42 in such a way that the sleeve passage (and therefore the workpiece-spindle axis 14 essentially coaxial to the latter) which is formed in the third slide 42 leads through approximately at mid-height between the two guide rods 46, 48 of the second linear guide.

On the front side of the second slide 50, the said front side being remote from the third slide 42 and facing the workpiece-spindle headstock, is arranged a second grinding wheel 54, designated as the auxiliary grinding wheel 54, which is mounted rotatably with respect to the second slide 50 about an essentially horizontal second tool axis 56 arranged parallel to the workpiece-spindle axis 14. The second slide 50 and the third slide 42 and also the second and the third linear guide are part of a second advancing device which serves for advancing the second grinding wheel 54 in the manner of a cross slide in an essentially horizontal plane towards the workpiece 18 and for moving it away from the latter again. In this case, the second advancing device is designed and arranged in such a way that the second grinding wheel 54 is arranged on that side of the workpiece 18 which is located opposite the first grinding wheel 20 with respect to the workpiece-spindle axis 14 or the workpiece 18 and, from this side, can be advanced towards the workpiece 18 and moved away from the latter again.

The second grinding wheel 54 is designed for grinding an externally conical face of the workpiece 18, this externally conically workpiece face being adjacent to the cylindrical workpiece face ground by the first grinding wheel 20, in such a way that a sharp circular transition edge is formed between them. The second grinding wheel 54 has a wheel diameter of approximately 100 mm and is driven by a motor (not illustrated) in such a way that, during grinding, the said grinding wheel rotates at a rotational speed of approximately 6000 rev/min about the second tool axis 56.

The tailstock 30 has arranged on it, further, a trueing unit which comprises a trueing-spindle headstock 58 which is adjustable pivotably with respect to the tailstock 30 about a vertical pivot axis and in which is mounted a trueing spindle which is rotatable about an essentially horizontal trueing-spindle axis. On the trueing spindle is arranged a trueing wheel 60 which is designed for trueing the second grinding wheel 54. The trueing unit is arranged on that side of the second grinding wheel 54 which is located opposite the workpiece-spindle axis 14, in such a way that the second grinding wheel 54 can be moved selectively either towards the workpiece 18 or towards the trueing wheel 60 by means of the second slide 50. The grinding wheel 54 can also be moved with two degrees of translational freedom in one plane with respect to the trueing wheel 60 and/or to the workpiece 18, in that the second slide 50 and the third slide 42 are in each case moved at the same time along their assigned linear guides (also designated as an interpolating motion or movement of the grinding wheel 54).

FIGS. 1 and 2 show the external circular grinding machine 10 in a working position in which both the first grinding wheel 20 and the second grinding wheel 54 are advanced towards the workpiece 18 and the workpiece 18 is simultaneously ground by the two grinding wheels 20, 54. The first grinding wheel 20 and the workpiece-spindle headstock are not illustrated in FIG. 3 for the sake of clarity. FIG. 2 illustrates the external circular grinding machine 10 in a working position in which the second grinding wheel 54 is moved along the second linear guide away from the workpiece 18 towards the trueing wheel 60 and in which the first grinding wheel 20 has been moved away from the workpiece 18.

The external circular grinding machine 10 illustrated in FIGS. 1–3 comprises, further, a first measuring device (not illustrated) which is arranged on the fourth slide and which is designed for measuring the removal from the workpiece 18 caused during the grinding by means of the first grinding wheel 20, a second measuring device (not illustrated) which is arranged on the fourth slide and which is designed for measuring the removal from the workpiece 18 caused during grinding by means of the second grinding wheel 54, and a control device (not illustrated) which is designed for controlling the first and the second advancing device.

In another variant of an external circular grinding machine according to the invention, not illustrated in FIGS. 1–3, the second measuring device is not arranged on the fourth slide, but on the sleeve.

In an external circular grinding machine according to a further variant of the invention not illustrated in the figures, the workpiece-spindle headstock, the tailstock and the first measuring device are arranged in a stationary manner on the machine bed. In order nevertheless to allow a plane relative movement with two degrees of translational freedom between the workpiece and the main grinding wheel, for this purpose the main grinding wheel is arranged on a cross slide which is moveable with two degrees of translational freedom in one plane with respect to the machine bed.

In order, by means of the external circular grinding machine 10 illustrated in FIGS. 1–3, to grind the cylindrical and the externally conical faces of the workpiece 18 in such a way that a sharp, burr-free, circular transition edge is formed between them, first the removal amount to be ground down from the workpiece 18 by means of the first grinding wheel 20 in a first grinding operation is measured by means of the first removal measuring device. The measurement result of the first removal measuring device is transmitted to the machine control which determines from this the first time span necessary for completing the first grinding operation. At the same time, the removal amount to be ground down from the workpiece 18 by means of the second grinding wheel 54 in a second grinding operation is measured by means of the second removal measuring device. The measurement result of the second removal measuring device is likewise transmitted to the machine control which determines from this the second time span necessary for completing the second grinding operation. Thereafter, the machine control determines the difference between the first and the second time span. Subsequently, the two grinding operations are started, the machine control controlling the first and the second advancing device in such a way that that grinding operation for which the shorter time span up to the completion of the grinding operation has been determined is started, according to the time difference, after the start of the other grinding operation. This has the effect that the two grinding operations are completed at the same time.

According to another variant of the invention, the time difference is not determined automatically by the machine control. Instead, first, the two removal amounts to be removed from a workpiece are measured by means of the first and the second removal measuring device, whereupon an operator calculates from these removal amounts the time spans for completing the two grinding operations and the time difference between these time spans. Thereafter, the operator programmes the machine control for machining a series of workpieces designed essentially identically to one another, the starting points for the two grinding operations which are to be carried out on each workpiece being fixed so as to be offset by the amount of time difference which has been calculated from the time spans determined for carrying out the grinding operation. Subsequently, the series of workpieces to be machined is machined with permanently programmed time switch points.

In summary, it may be stated that, by virtue of the invention, a method and an apparatus for abrasive circular machining are specified, which allow a reliable and accurate machining of workpieces with a sharp and burr-free transition edge between two rotationally symmetrical faces, even in the manufacture of large series.

What is claimed is:

1. Method for abrasive circular machining of a workpiece which has a workpiece axis and, while the method is being carried out, rotates about the workpiece axis, whilst at the same time a first abrasive tool rotating about a first tool axis and the workpiece are advanced towards one another, in order to machine a first workpiece face in a first abrasive operation, wherein a second abrasive tool rotating about a second tool axis is advanced towards the workpiece, in order to machine a second workpiece face in a second abrasive operation, the two workpiece faces being designed rotationally symmetrically with respect to the workpiece axis and being arranged adjacently to one another in such away that a circular transition edge is formed between them, and the two abrasive operations being terminated at the same time.

2. Method according to claim 1, wherein at least one of the two abrasive operations is carried out by measurement control.

3. Method according to claim 1 or 2, at least one of the two workpiece faces is designed conically.

4. Abrasive apparatus for the abrasive circular machining of a workpiece, with a workpiece spindle which rotates about a workpiece-spindle axis and which is provided with a workpiece holder designed for receiving the workpiece, with a first abrasive tool rotating about a first tool axis and with a first advancing device in order to advance the first abrasive tool and the workpiece towards one another, wherein the apparatus comprises, further, a second abrasive tool rotating about a second tool axis, a second advancing device for advancing the second abrasive tool towards the workpiece and a control device for controlling the abrasive apparatus in such a way that the first abrasive tool and the workpiece are advanced towards one another by means of the first advancing device, in order to machine a first workpiece face in a first abrasive operation, and in that the second abrasive tool is advanced towards the workpiece by means of the second advancing device, in order to machine a second workpiece face n a second abrasive operation, the two workpiece faces being designed rotationally symmetrically with respect to the workpiece-spindle axis and being arranged adjacently to one another in such a way that a circular transition edge is formed between them, and the control device for controlling the two advancing devices being designed in such a way that the two abrasive operations are terminated at the same time.

5. Abrasive apparatus according to claim 4, wherein the first advancing device comprises a first slide, by means of which either the workpiece together with the workpiece spindle, or the first abrasive tool can be moved along a first straight linear guide obliquely or at right angles to the workpiece-spindle axis, in order to advance the first abrasive tool and the workpiece towards one another.

6. Abrasive apparatus according to claim 5, wherein the second advancing device comprises a second slide, by means of which the second abrasive tool can be moved along a second straight linear guide obliquely or at right angles to the workpiece-spindle axis, in order to advance the second abrasive tool towards the workpiece from a side located opposite the first abrasive tool with respect to the workpiece, the second linear guide comprising at least two elongate guide elements which guide the second slide and define the direction of movement of the second slide and which define two axes parallel to one another and are arranged in such a way that the workpiece-spindle axis leads through between the two axes.

7. Abrasive apparatus according to claim 6, wherein the second abrasive tool is a grinding wheel, and in that the abrasive apparatus comprises, further, a trueing tool for trueing the grinding wheel, the trueing tool being arranged on that side of the grinding wheel which is located opposite the workpiece-spindle axis, in such a way that the grinding wheel can be moved selectively either towards the workpiece or towards the trueing tool by means of the second slide.

8. Abrasive apparatus according to claim 5, wherein the second advancing device comprises a third slide, by means of which the second abrasive tool can be moved, parallel to the workpiece-spindle axis, along a third straight linear guide, the third linear guide comprising at least three elongate guide elements which guide the third slide and define the direction of movement of the third slide and which in each case define an axis parallel to the workpiece-spindle axis and are arranged in such a way that the workpiece-spindle axis lies within a space delimited by an envelope around the at least three axes of the third linear guide.

9. Abrasive apparatus according to claim 8, wherein the third linear guide arranged on the tailstock in such a way that the third slide can be moved along the third linear guide with respect to the tailstock, and, in an arrangement leading through a passage formed in the third slide, the sleeve is connected to the tailstock.

10. Abrasive apparatus according to claim 5, wherein it comprises, further, a tailstock which is provided with a sleeve for stabilizing one longitudinal end of the workpiece during the workpiece machining, the second advancing device being arranged on the tailstock.

* * * * *